US010016884B2

(12) United States Patent
Wu et al.

(10) Patent No.: US 10,016,884 B2
(45) Date of Patent: Jul. 10, 2018

(54) PNEUMATIC NAIL GUN CAPABLE OF STRIKING NAILS IN AUTOMATIC MODE

(71) Applicant: DE POAN PNEUMATIC CORP., New Taipei (TW)

(72) Inventors: I-Tsung Wu, Taipei Hsien (TW); Hai-Lun Ma, Taipei Hsien (TW); Zhen-Liang Liao, Taipei Hsien (TW)

(73) Assignee: DE POAN PNEUMATIC CORP., New Taipei (TW)

( * ) Notice: Subject to any disclaimer, the term of this patent is extended or adjusted under 35 U.S.C. 154(b) by 706 days.

(21) Appl. No.: 14/594,780

(22) Filed: Jan. 12, 2015

(65) Prior Publication Data

US 2016/0151900 A1 Jun. 2, 2016

(30) Foreign Application Priority Data

Dec. 1, 2014 (TW) ..... 103221280 U

(51) Int. Cl.
*B25C 1/04* (2006.01)

(52) U.S. Cl.
CPC ..... *B25C 1/043* (2013.01); *B25C 1/047* (2013.01)

(58) Field of Classification Search
USPC ..... 227/130
See application file for complete search history.

(56) References Cited

U.S. PATENT DOCUMENTS 3,583,496 A 6/1971 Fehrs
3,771,710 A * 11/1973 Perkins ..... B25C 1/043 227/130
4,384,668 A * 5/1983 Tutomu ..... B25C 1/008 227/8
4,550,643 A 11/1985 Schwartzenberger
4,736,879 A * 4/1988 Yamada ..... B25C 1/041 227/130
4,784,308 A 11/1988 Novak et al.
5,080,273 A 1/1992 Meyer
5,083,694 A 1/1992 Lemos
5,522,532 A 6/1996 Chen
5,628,444 A 5/1997 White
5,785,228 A 7/1998 Fa et al.
5,896,933 A 4/1999 White
5,911,351 A * 6/1999 White ..... B25C 1/043 227/130
7,448,524 B1 11/2008 Liang et al.
7,931,180 B2 4/2011 Lai

* cited by examiner

*Primary Examiner* — Michelle Lopez
*Assistant Examiner* — Chinyere Rushing-Tucker
(74) *Attorney, Agent, or Firm* — Chun-Ming Shih

(57) ABSTRACT

A pneumatic nail gun operated in automatic actuation mode includes a gun body, a trigger valve, and a shuttle valve. The gun body defines therein a main chamber and is provided with a forward air conduit and a return air conduit. The forward air conduit provides a path for the pressurized air in the main chamber to force a valve stem of the shuttle valve to conduct a forward movement for a drive stroke. The return air conduit provides a path for the pressurized air in the cylinder to force the valve stem to conduct a return movement after the nail gun has completed the drive stroke. By depressing an actuating bar of the trigger valve a single time, the valve stem can be forced to conduct repeated forward and return movements, and thus the nail gun can conduct repeated drive strokes for stably striking a nail.

17 Claims, 10 Drawing Sheets

PNEUMATIC NAIL GUN CAPABLE OF STRIKING NAILS IN AUTOMATIC MODE

TECHNICAL FIELD OF THE INVENTION

The present invention relates to a pneumatic nail gun and, more particularly, to a pneumatic nail gun provided with a shuttle valve, which allows the nail gun to be stably operated in automatic actuation mode for striking nails.

DESCRIPTION OF THE PRIOR ART

Pneumatic nail guns are a tool that employs pressurized air to move a piston thereof to conduct a drive stroke for striking a nail and a return stroke for preparing a next striking. Generally, the operation of a pneumatic nail gun can be divided into two modes: restriction actuation and contact actuation.

When a pneumatic nail gun is operated in restrictive actuation mode, at first, the user should place a contact head of the nail gun against a workpiece to have a safety bar associated therewith push a spring of the gun's trigger. Next, the trigger of the nail gun can be pulled to initiate a drive stroke for striking a nail into the workpiece. In this mode, when a second drive stroke is required, the user should release the trigger and then pull the trigger again. When the operational sequence of the nail gun is violated, i.e., the trigger is pulled before depressing the safety bar or the contact head, the trigger's spring cannot be moved to a state that allows the trigger valve to act properly, thereby disabling the function of initiating a drive stroke on the nail gun.

When the pneumatic gun is operated in contact actuation mode, at first, the user can pull the trigger before placing the contact head against a workpiece (which in turn pushes the safety bar). In this situation, when each time the user places the contact head against a workpiece, the trigger's spring will be acted by the safety bar to have the gun conduct a drive stroke for striking a nail. As such, while the trigger is kept in the pulled state, the user can fire a stroke simply by placing the contact head against a workpiece. For a next stroke, the user can simply draw back the contact head from contacting the workpiece to release the safety bar and then place the contact head against a workpiece intended to be fastened. Additionally, in this mode, the user can also place the contact head against a workpiece before pulling the trigger. In this situation, when the user pulls the trigger, the nail gun will conduct a drive stroke that can strike a nail into the workpiece. For conducting a second stroke, the user should release the trigger and pull the trigger again. For conducting repeated strokes, the user should continuously pulls and release the trigger.

In view of the foregoing, no matter which mode a pneumatic nail gun is operated under, the nail gun should be provided with a safety bar and a trigger (together with a trigger valve) to control a poppet valve and work with a piston thereof, so that the pressurized air supplied to the nail gun can be directed by some passages to force the piston together with its drive blade to conduct a drive stroke for striking a nail into a workpiece, or the pressurized air can be directed by other passages to allow the piston to return to its initial position.

Currently, under the demand of automatic nailing operation, some automatic machine has incorporated a pneumatic nail gun, wherein the trigger of the nail gun can be pulled by the automatic machine, and the contact head or the safety bar of the nail gun can be depressed by the automatic machine against a workpiece intended to be fastened. In the automatic machine, the safety bar, which serves as a safety switch for operating the nail gun, is an indispensable device. However, in the existing technology, when the safety bar has been depressed, the nail gun or the automatic machine incorporating a nail gun cannot fire multiple strokes by pulling the trigger a single time; namely, the nail gun or the automatic machine of the existing technology is unable to afford an operation of automatic actuation mode. In this specification, the term of automatic actuation means that a user or an automatic machine only requires to pull the trigger a single time to have the nail gun conduct repeated forward and backward motions, irrespective of the nail gun being implemented as an individual tool or incorporated into an automatic machine Accordingly, the term of automatic actuation defined in this specification is different than restriction actuation mode, as mentioned above, which requires a user to release the trigger and then pull the trigger a second time to have the nail gun conduct a second stroke. Thus, when a pneumatic nail gun is operated in automatic actuation mode, a user or an automatic machine incorporating the nail gun can save the burden of pulling and releasing the trigger repeatedly.

Furthermore, there are some patents of pneumatic nail gun being issued. For example, in U.S. Pat. No. 7,448,524, a trigger valve can be employed together with a safety bar to control the movement of the piston of the nail gun for striking nails. In U.S. Pat. No. 7,931,180, a plurality of valves are cooperated with a safety lever, a trigger and the associated trigger valve to control the movement of the piston of the nail gun for striking nails. In U.S. Pat. No. 4,784,308, a return valve is provided at the head portion of the gun housing to control the flow direction of pressurized air. In U.S. Pat. No. 5,896,933, a main valve is arranged between a trigger and an upper end of a cylinder thereof to control the movement of the piston fitted in the cylinder for striking nails. However, the above-disclosed nail guns can only be operated in restriction actuation mode or contact actuation mode. They cannot be operated in automatic actuation mode; namely, they cannot achieve the function of conducting repeated strokes by pulling and releasing the trigger a single time. Besides, due to the complex designs of pneumatic passages or conduits, they may have a problem in the stability of operating the nail guns, especially when they are applied in an operation that requires striking nail fast and repeatedly.

SUMMARY OF THE INVENTION

One object of the present invention is to provide a pneumatic nail gun which has a simplified structure and can be operated in automatic actuation mode for fast, repeatedly striking nails. Accordingly, the present invention provides a first embodiment, which generally comprises a gun body, a trigger valve, a shuttle valve, a forward air conduit, and a return air conduit. The gun body is provided therein with a cylinder and a poppet valve on top of the cylinder. Furthermore, the gun body defines therein a main chamber being supplied with pressurized air and defines therein a top chamber over the poppet valve, wherein a piston together with a drive blade is slidably fitted in the cylinder. The trigger valve, which is mounted to the gun body, communicates with the top chamber via a trigger passage composed of a first segment and a second segment for regulating the pressurized air in the main chamber to enter the top chamber via the trigger passage and regulating the pressurized air in the top chamber to be released to atmosphere via the trigger passage. The shuttle valve, which is mounted to the gun body, includes a substantially cylindrical, movable valve stem. The forward air conduit and the return air conduit are provided in the gun body for guiding the pressurized air in the main chamber to flow into the shuttle valve to cause forward and return movement of the valve stem of the shuttle valve for regulating the pressurized air in the main chamber to enter the top chamber via the trigger passage, so that the drive blade can be forced to conduct repeated drive strokes for striking a nail in automatic actuation mode.

More specifically, the first embodiment may further comprise the following features:

The shuttle valve further includes a tubular valve seat fixed in the gun body, and the valve stem is mounted in the tubular valve seat and movable along a longitudinal, central axis of the tubular valve seat. The gun body includes a cover which accommodates the valve seat and the valve stem of the shuttle valve. The valve stem of the shuttle valve has a first end surface and a second end surface respectively at two opposite ends thereof. The gun body defines a first chamber and a second chamber, wherein the first end surface of the valve stem is exposed to the first chamber while the second end surface of the valve stem is exposed to the second chamber. The first end surface has a pneumatically acted area greater than the second end surface. The forward air conduit is connected between the main chamber and the second chamber. The return air conduit is connected between at least one return port, which is defined at the cylinder, and the first chamber. When the pneumatic nail gun conducts a drive stroke, the piston will pass by the return port and the drive blade will move from a top position to a bottom position. A first control portion and a second portion are provided at the valve stem within the valve seat. A first guide hole is defined at the valve seat to communicate with the trigger valve via the first segment of the trigger passage. A second guide hole is defined at the valve seat to communicate with the top chamber via the second segment of the trigger passage. The first control portion regulates a communication between the first guide hole and the second guide hole. A third guide hole is defined at the valve seat to communicate with the main chamber via an additional air conduit. The second control portion regulates a communication between the third guide hole and the second guide hole. The additional air conduit is connected to the forward air conduit. The second control portion is located between the first control portion and the second end surface of the valve stem.

The first embodiment may further comprise a throttle valve defining therein a throttle passage that is in serial connection with the return air conduit. The throttle valve includes a threaded bolt being fitted into the throttle passage for adjusting the flow of pressurized air passing through the throttle passage. The throttle valve is accommodated in the cover. The threaded bolt has a head being exposed to an outer surface of the cover to facilitate a user to adjust the throttle valve.

The first embodiment may further comprise a switching device including a spring-biased control element capable of moving between a first position and a second position. When the control element is at the first position, the control element is in contact with the second end surface of the valve stem, so that forward and return movements of the valve stem will be blocked. When the control element is at the second position, the control element is clear of the second end surface of the valve stem so that forward and return movement of the valve stem will be permitted. The switching device is accommodated in the cover. The control element of the switching device has an operable end being exposed to an outer surface of the cover.

Additionally, the present invention provides a second embodiment, which differs from the first embodiment in that: the valve stem of the shuttle valve has a head portion embodying the first end surface and serving as the second control portion for regulating a communication between the second guide hole and the first chamber.

More specifically, the second embodiment may further comprise the following features:

When the pressurized air in an upper cylinder chamber of the cylinder is transferred via the return air conduit to the first chamber, the valve stem will conduct a return movement to start a communication between the first chamber and the second guide hole. When a lower cylinder chamber of the cylinder is communicated with the first chamber via the return air conduit, the pressurized air in the second chamber will force the valve stem to conduct a forward movement to stop the communication between the first chamber and the second guide hole. A third guide hole is defined at the valve seat for communicating the forward air conduit with the second chamber. The second end surface of the valve stem includes two coaxially annular surfaces being exposed to the second chamber.

The second embodiment may further comprise a throttle valve and/or a switching device, as described in the first embodiment.

As a summary, the present invention provides a pneumatic nail gun that can be operated under automatic actuation mode in addition to the existing restrictive actuation mode and contact actuation mode. When the nail gun is operated under automatic actuation mode, the shuttle valve can withstand repeated forward and return movements to have the nail gun function stably. Besides, the present invention can simplify the structure of a nail gun, and save the manufacturing cost of a nail gun.

Other objects, advantages, and novel features of the present invention will become more apparent from the following detailed description when taken in conjunction with the accompanying drawings.

DETAILED DESCRIPTION OF THE PREFERRED EMBODIMENTS

To illustrate the technical contents of the present invention, two embodiments are provided in the following paragraphs.

Referring first to FIGS. 1 through 5, 6*a*, 6*b*, 6*c*, 6*d* and 6*e*, a pneumatic nail gun according to a first embodiment of the present invention is shown, which generally comprises a gun body 1, a trigger valve 2, and a shuttle valve 3.

Figure 1:
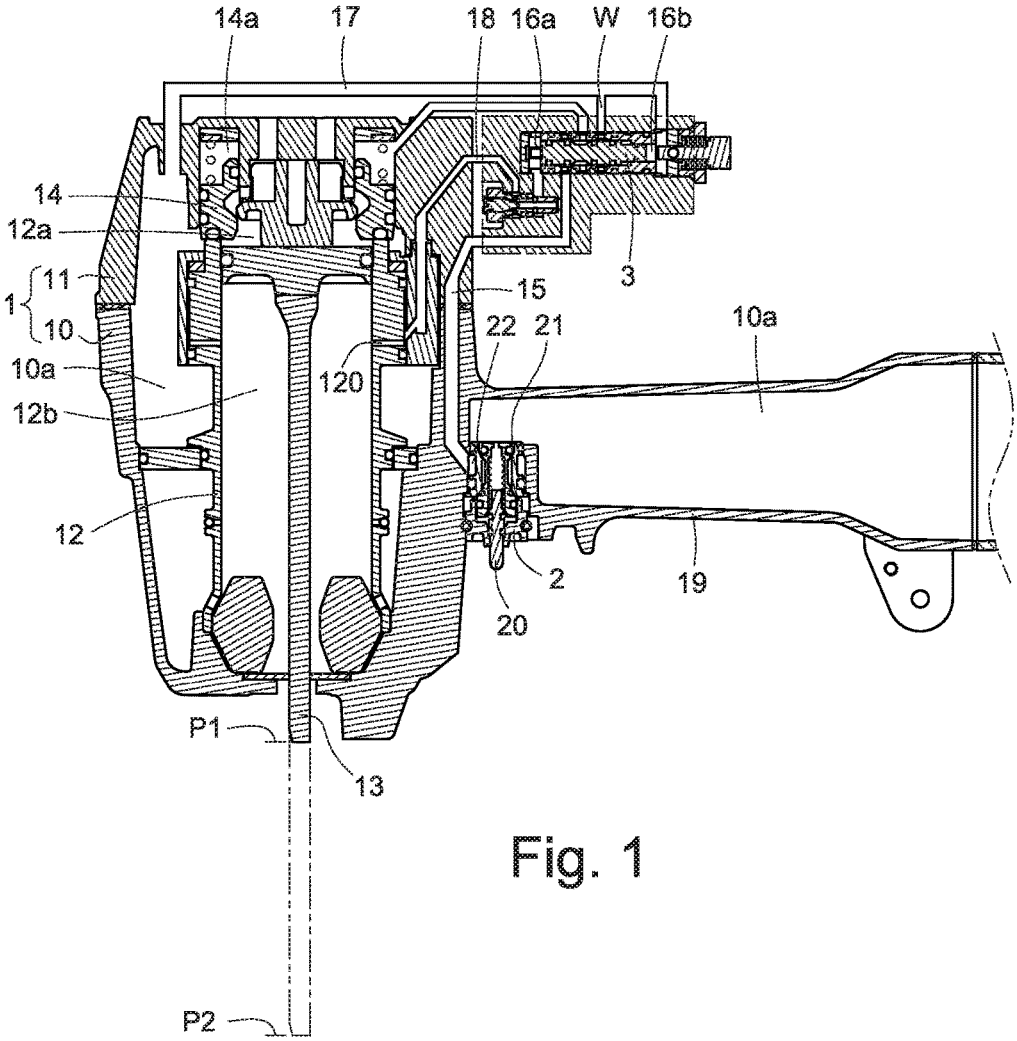
FIG. 1 shows a sectional view of a pneumatic nail gun according to a first embodiment of the present invention.

As shown in FIG. 1, the gun body 1 includes a main housing 10 and a cover 11 on top of the main housing 10. The main housing 10 is provided therein with a cylinder 12. A piston together with a drive blade 13 is slidably fitted in the cylinder 12, so that the interior of the cylinder 12 is divided into an upper chamber 12*a* and a lower chamber 12*b*, each of which has a variable volume. On top of the piston is provided with a poppet valve 14, which is a discoid element biased by a spring. On top of the poppet valve 14 is defined with a top chamber 14*a*. Also, the gun body 10 defines therein a main chamber 10*a*, which is supplied with pressurized air from a source (not shown). The gun body 10 also includes an integrally formed handle 19. As shown, the main chamber 10*a* includes the interior of the handle 19 and the space around the cylinder 12 and the poppet valve 14.

As shown in FIG. 1, the trigger valve 2 is mounted at a side of the gun body 1, and particularly at a side of the handle 19 of the gun body 1, to facilitate a user's fingers or an actuating lever of an automatic machine to depress and release the actuating bar 20 of the trigger valve 2. The trigger valve 2 has a first passage 21 communicating with the main chamber 10*a* which is full of pressurized air. The gun body 1 defines a trigger passage 15 communicating with a second passage 22 of the trigger valve 2. More specifically, the trigger passage 15 is composed of a first segment (lower segment) and a second segment (upper segment), wherein the first segment of the trigger passage 15 communicates with the second passage 22 of the trigger valve 2.

In FIG. 1, the shuttle valve 3 is located outside of the main housing 10 of the gun body 1 for showing the associated air passages more clearly. In fact, the shuttle valve 3 can be mounted inside of the gun body 1 or a separate structure fixed to the gun body 1. When the shuttle valve 3 is mounted inside of the gun body 1, it can be mounted in the main housing 10 or the cover 11. For simplifying the illustration of the pneumatic passages within the gun body 1, the shuttle valve 3 of each embodiment being illustrated in this specification is mounted in the cover of its gun body. However, such arrangement of the shuttle valve 3 should not be construed as a limitation for the mounting location of the shuttle valve 3.

Figure 2:
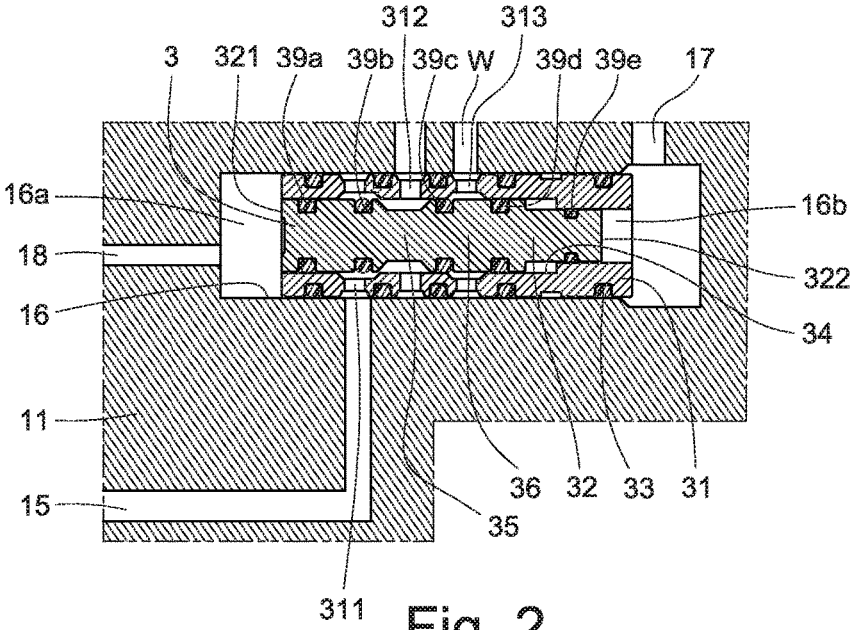
FIG. 2 shows an enlarged sectional view of a shuttle valve employed in the pneumatic nail gun of the first embodiment of the present invention.

Referring to FIG. 2, the shuttle valve 3 includes a tubular valve seat 31 and a cylindrical valve stem 32. The cover 11 of the gun body 1 defines a bore 16 for mounting the valve seat 31. Furthermore, the valve seat 31 is provided at its outer surface with a plurality of gas-tight seal rings 33, which are in contact with the inner surface of the bore 16. The tubular valve seat 31 defines along its longitudinal, central axis an inner bore 34, within which the cylindrical valve stem 32 can be slidably fitted. In other words, the valve stem 32 is fitted in the valve seat 31 such that it can slide along the inner bore 34 in the direction of the longitudinal, central axis.

In FIG. 2, there is provided a first control portion 35 and a second control portion 36 at the valve stem 32. The tubular valve seat 31 defines at its wall a first guide hole 311 to communicate with the trigger valve 2 via the first segment (lower segment) of the trigger passage 15, and a second guide hole 312 to communicate with the top chamber 14*a* via the second segment (upper segment) of the trigger passage 15. Furthermore, the tubular valve seat 31 defines at its wall a third guide hole 313 to communicate with the main chamber 10*a* via an air conduit (W). The valve stem 32 is provided, along the longitudinal, central axis of the valve seat 31, with spaced-apart, gas-tight seal rings 39*a*, 39*b*, 39*c*, 39*d* and 39*e*, which are in contact with the inner surface of the valve seat 31. The portion between the seal rings 39*b*, 39*c* constitutes the first control portion 35, which regulates a communication between the first guide hole 311 and the second guide hole 312, which in turn controls a communication between the top chamber 14*a* and the trigger valve 2 by way of the trigger passage 15. The portion between the seal rings 39*c*, 39*d* constitutes the second control portion 36, which regulates a communication between the second guide hole 312 and the third guide hole 313, which in turn controls a communication between the top chamber 14*a* and the main chamber 10*a* by way of the air conduit (W) which is connected to a forward air conduit 17. Furthermore, the seal ring 39*a* is located between a first chamber 16*a* and the first guide hole 311 to prevent a communication therebetween; the seal ring 39*e* is located between a second chamber 16*b* and the third guide hole 313 to prevent a communication therebetween.

Referring to FIG. 2, the valve stem 32 has a first end surface 321 and a second end surface 322 respectively at two opposite ends thereof. The valve seat 31 is fitted with the bore 16 of the cover 11 such that the first chamber 16*a* and the second chamber 16*b* are respectively defined at two opposite end portions of the bore 16, next to the opposite ends of the valve stem 32, wherein the first end surface 321 is exposed to the first chamber 16*a*, while the second end surface 322 is exposed to the second chamber 16*b;* as such, air existed in the first and second chambers 16*a*, 16*b* can respectively act on the first and second end surfaces 321, 322. Furthermore, the second control portion 36 is located between the first control portion 35 and the second end surface 322.

More specifically, in this embodiment, the first end surface 321 has a pneumatically acted area greater than the second end surface 322, which facilitates the valve stem 32 to conduct forward and return movements for regulating the sequence of introducing pressurized air to various elements of the nail gun. However, when the air conduit or passage connected with the first chamber 16*a* (or the second air chamber 16*b*) is installed with a throttling element that can adjust the flow of pressurized air (such as a throttle valve described later in this specification). The area limitation between the first and second end surface 321, 322 can be eliminated. Thus, either the area limitation between the two end surfaces 321, 322 or the use of a throttle element can be applied in the present invention for adjusting the flow of pressurized air into the first chamber 16*a*. It is possible that the area limitation between the end surfaces 321, 322 is applied together with an installation of a throttle valve.

Figure 3:
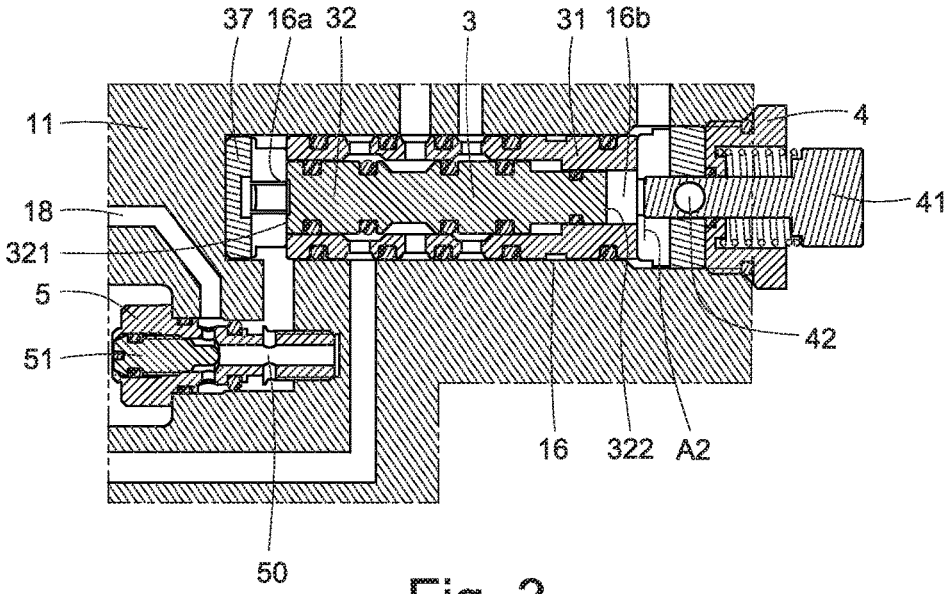
FIG. 3 shows an enlarged sectional view of the shuttle valve, together with a throttle valve and a switching device, employed in the pneumatic nail gun of the first embodiment of the present invention, wherein the switching device is at a second position.

FIG. 3 shows a sectional view of the shuttle valve 3, together with a switching device 4, employed in the first embodiment. In manufacturing the nail gun, the bore 16 of the cover 11 can be formed by using a drilling tool, and then the inner cap 37, the valve seat 31, the valve stem 32, and the switching device 4 can be assembled into the bore 16 from the outside. Consequently, the first chamber 16*a* and the second chamber 16*b* can be defined in the cover 11, wherein the inner cap 37 is in contact with an inner end of the valve seat, and thus the first chamber 16*a* is defined between the inner cap 37 and the first end surface 321. On the other hand, the switching device 4 can seal the entrance of the bore 16, wherein the switching device 4 includes a spring-biased control element 41 being provided with an engagement pin 42 near its free end. The control element 41 can be operated to move between a first position (A1) (see FIG. 4) and a second position (A2) (see FIG. 3). A user can depress and rotate the control element 41 to move it from the second position (A2) to the first position (A1) where the engagement pin 42 can fix the control element 41 in the first position (A1).

Figure 4:
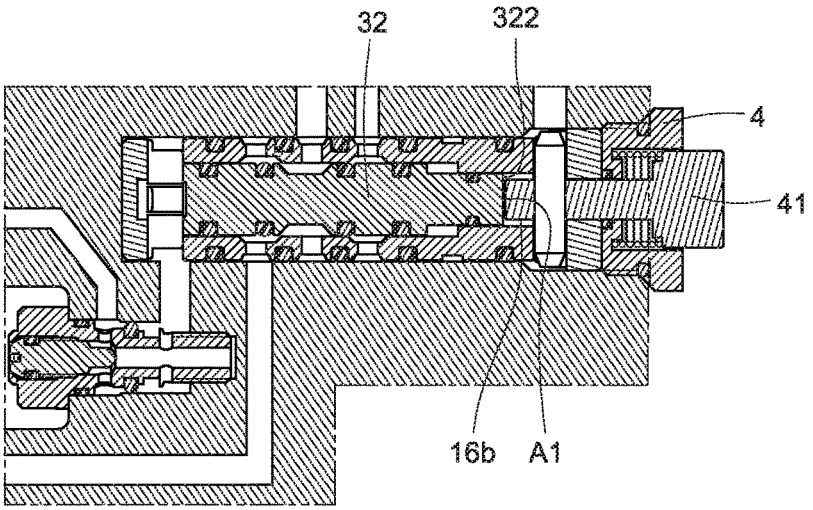
FIG. 4 shows an enlarged sectional view of the shuttle valve, together with the throttle valve and the switching device, employed in the pneumatic nail gun of the first embodiment of the present invention, wherein the switching device is at a first position.

FIG. 4 shows that the control element 41 of the switching device 4 is located at the first position (A1), wherein the control element 41 abuts the second end surface 322 by its free end within the second chamber 16*b*. In this case, although the nail gun cannot be operated under automatic actuation mode, it can be operated under restrictive actuation mode or contract actuation mode. FIG. 3 shows that the control element 41 of the switching device 4 is located at the second position (A2), wherein the control element 41 is clear of the second end surface 322 of the valve stem 32, and this allows the valve stem 32 to freely move along the inner bore 34 of the valve seat 31 to conduct a forward movement (towards the first chamber 16*a*) and a return movement (towards the second chamber 16*b*), so that the nail gun can be operated under automatic actuation mode to strike nails.

Figure 5:
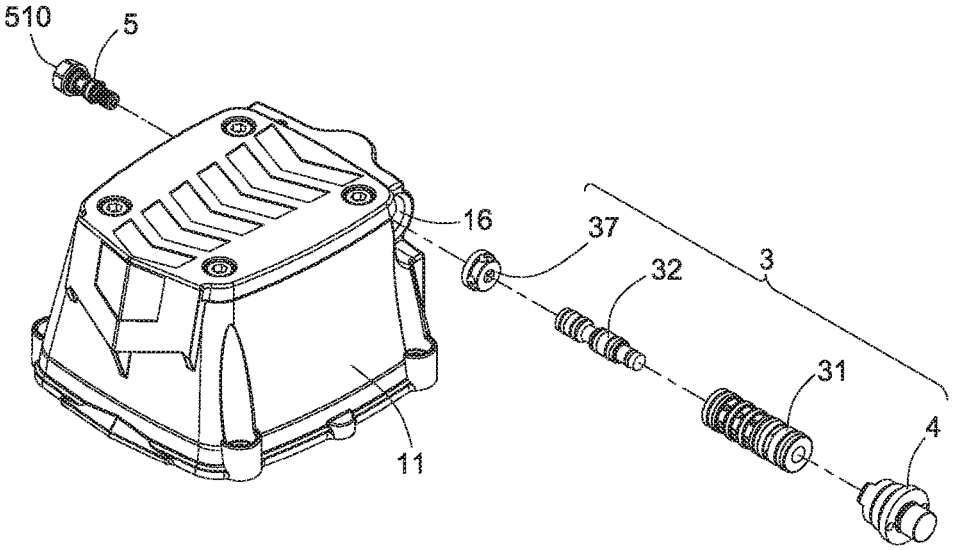
FIG. 5 shows an exploded view of the shuttle valve, the throttle valve, and the switching device mounted to a cover of the pneumatic nail gun of the first embodiment of the present invention.

FIG. 5 shows an exploded view of the shuttle valve 3 together with a throttle valve 5 (which will be described later in this specification) and the switching device 4, all of which are assembled into the bore 16 defined at the cover 11.

Referring again to FIG. 1, the gun body 1 is provided therein with the forward air conduit 17, as mentioned above, and a return air conduit 18. The forward air conduit 17 is used for communicating the main chamber 10*a* with the second chamber 16*b*. The return air conduit 18 is used for communicating a return port 120 with the first chamber 16*a*, wherein the return port 120 is defined at the cylinder 12. More specifically, the return port 120 is open at the inner surface of the cylinder 12 such that the piston can pass by the return port 120 when conducting a drive stroke. As shown, the nail gun can conduct a drive stroke to have the tip of the drive blade 13 move from a top position (P1) to a bottom position (P2). When the piston passes by the return port 120, the return port 120 can communicate with the upper cylinder chamber 12*a* (see FIG. 6*c*). On the other hand, the nail gun can conduct a return stroke to have the tip of the drive blade 13 move from the bottom position (P2) to the top position (P1). When the piston passes by the return port 120, the return port 120 can communicate with the lower cylinder chamber 12*b* again (see FIG. 6*e*).

Referring to FIG.1 in conjunction with FIG. 3, the cover 11 of the gun body 1 can be further provided with a throttle valve 5. Generally, the throttle valve 5 defines therein a throttle passage 50 which is in serial connection with the return air conduit 18. Furthermore, the throttle valve 5 is provided with a threaded bolt 51 being fitted into the throttle passage 50, so that it can provide a function of adjusting the flow of pressurized air going through the return air conduit 18, which is similar to a needle valve. More specifically, the throttle valve 5 can adjust the flow of pressurized air flowing from the upper cylinder chamber 12*a* to the first chamber 16*a* when the piston conducts a drive stroke and passes by the return port 120, so that the time required for filling the first chamber 16*a* to increase the air pressure therein for initiating a return movement can be adjusted, so that the striking frequency of the nail gun operated in automatic actuation mode can be adjusted. Incidentally, the throttle valve 5 can be provided together with the above-mentioned area limitation, where the pneumatically acted area of the first end surface 321 is greater than that of the second end surface 322, as mentioned above; or alternatively, the nail gun can be installed with the throttle valve 5 without providing the feature of the area limitation or the nail gun can be provided with the feature of the area limitation without installing the throttle valve 5.

FIGS. 3 and 5 show that the throttle valve 5 is mounted in alignment with the shuttle valve 3, wherein both valves are mounted in the cover 11. Furthermore, the thread bolt 51 has a head 510 being exposed to an outer surface of the cover 11 to facilitate a user to adjust the bolt 51 for controlling the time required for initiating a return movement of the valve stem 32. In other words, the speed of a return movement of the valve stem 32 can be controlled through the throttle valve 5.

The following paragraphs will illustrate the operation of the first embodiment of the pneumatic nail gun with reference to FIGS. 6*a*, 6*b*, 6*c*, 6*d* and 6*e*.

Figure 6A:
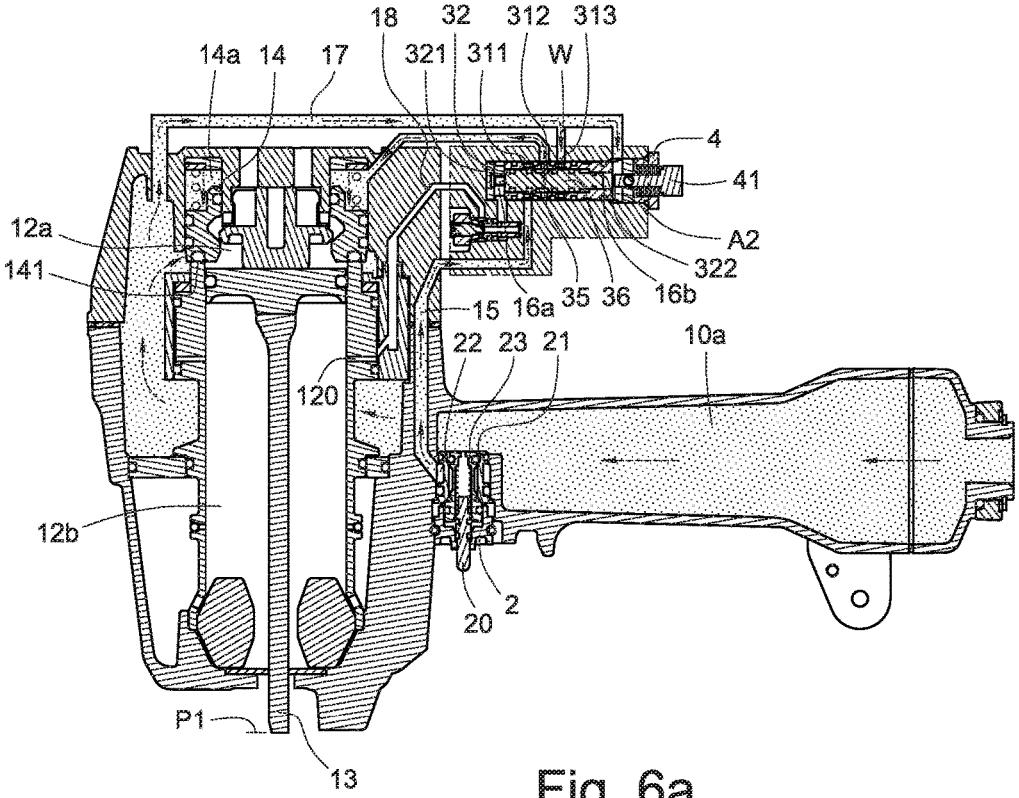
FIGS. 6*a*, 6*b*, 6*c*, 6*d* and 6*e* show working views of the pneumatic nail gun of the first embodiment of the present invention.

FIG. 6*a* shows that the control element 41 of the switching device 4 is located at the second position (A2), which allows the valve stem 32 of the shuttle valve 3 to conduct forward movement and return movements along the inner bore 34 of the valve seat 31, between the first chamber 16*a* and the second chamber 16*b*. The main chamber 10*a* is full of pressurized air and the actuating bar 20 of the trigger valve 2 is in a released state. The actuating bar 20 can control a valve plug 23 in the trigger valve 2 for allowing pressurized air in the main chamber 10*a* to enter the first segment (lower segment) of the trigger passage 15 via the first passage 21 and the second passage 22. In the beginning, when the actuating bar 20 of the trigger valve 2 has not yet been depressed, the drive blade 13 is located at the top position (P1), wherein the return air conduit 18 communicates with the lower cylinder chamber 12*b* via the return port 120 (the lower cylinder chamber 12*b* is communicated with atmosphere), so that the first chamber 16*a* is at a condition of lower pneumatic pressure. On the other hand, the pressurized air in the main chamber 10*a* can enter the second chamber 16*b* via the forward air conduit 17 and also can enter the third guide hole 313 via the forward air conduit 17 and the air conduit (W). Under these circumstances, the first chamber 16*a* is at a lower pneumatic pressure while the second chamber 16*b*, which is filled with pressurized air acting on the second end surface 322, is at a higher pneumatic pressure. Although with the compromise of the second end surface 322 having an area less than the first end surface 321, the pressurized air acting on the second end surface 322 is sufficient to have the valve stem 32 conduct a forward movement towards the first chamber 16*a*, so that the second control portion 36 can stop a communication between the second guide hole 312 and the third guide hole 313; meanwhile, the first control portion 35 can start a communication between the first guide hole 311 and the second guide hole 312, so that the pressurized air entering the first segment (lower segment) of the trigger passage 15 is permitted to enter the top chamber 14*a* via the second segment (upper segment) of the trigger passage 15, so that the poppet valve 14 can be forced to close the gap 141 between the poppet valve 14 and the cylinder 12, so that the pressurized air in the main chamber 10*a* will be blocked from entering the upper cylinder chamber 12*a*. Thus, the drive blade 13 can be maintained at the top position (P1).

Figure 6B:
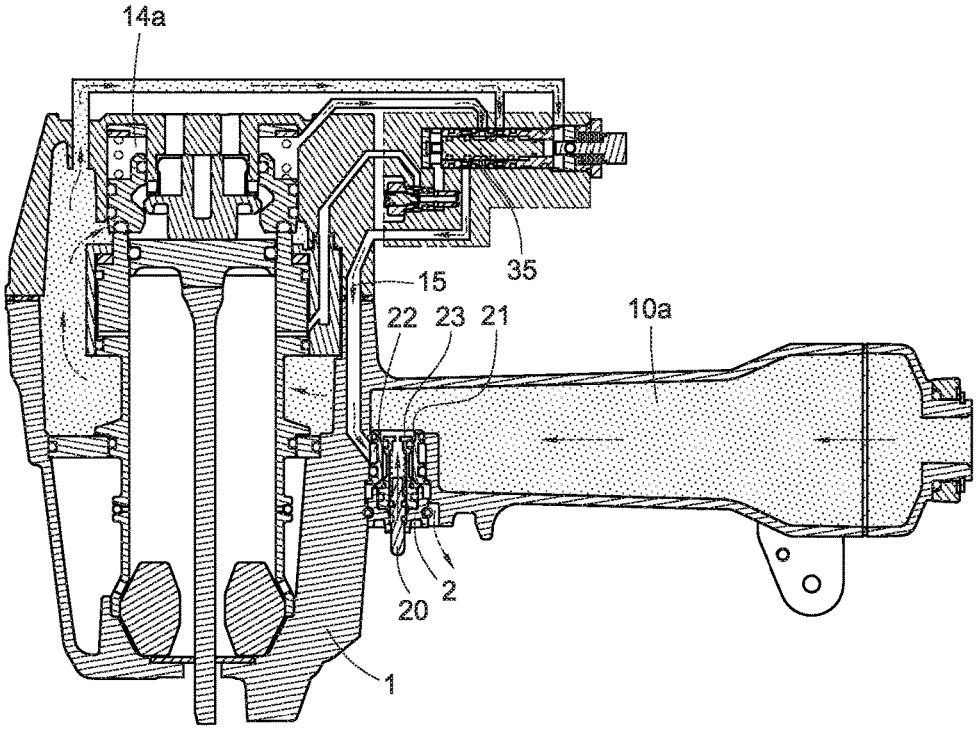

FIG. 6*b* shows that once the actuating bar 20 of the trigger valve 2 is depressed, the pressurized air in the main chamber 10*a* can force the valve plug 23 in the trigger valve 2 to stop a communication between the first passage 21 and the second passage 22 in the trigger valve 2, but start a communication between the first segment (lower segment) of the trigger passage 15 and atmosphere, so that the pressurized air in the first segment (lower segment) of the trigger passage 15 can be released to atmosphere. Through the first control portion 35, which now communicates the first segment of the trigger passage 15 with the second segment of the trigger passage 15, the pressurized air in the top chamber 14*a* can be released to atmosphere as well, so that the top chamber 14*a* will be at a condition of lower pneumatic pressure.

Figure 6C:
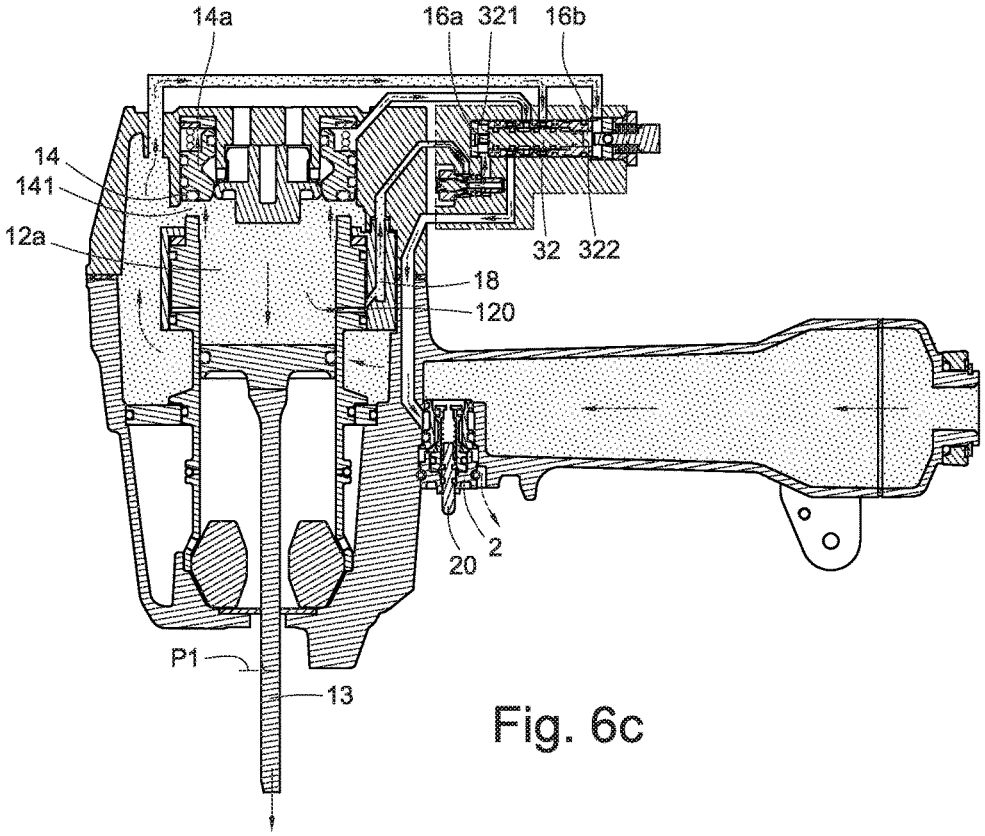

FIG. 6*c* shows that when the pneumatic pressure of the top chamber 14*a* is reduced to the extent that the pressurized air in the main chamber 10*a* can overcome the spring force exerted on the poppet valve 14, the poppet valve 14 can be moved up to open the gap 141 between the poppet valve 14 and the cylinder 12, so that the pressurized air in the main chamber 10*a* may enter the upper cylinder chamber 12*a* and thus the drive blade 13 together with the piston can be forced to move downwardly, from the top position (P1) to the bottom position (P2), thereby conducting a drive stroke for striking a nail into a workpiece. During the downward movement, when the piston passes by the return port 120, the return port 120 can communicate with the upper cylinder chamber 12*a* to allow the pressurized air therein to enter the first chamber 16*a* via the return port 120 and the return air conduit 18. At this moment, although the pressurized air in the main chamber 10*a* continues flowing into the second chamber 12*b*, due to the first end surface 321 having a pneumatically acted area greater than the second end surface 322, the valve stem 32 can be forced to move towards the second chamber 16*b* through the area differential, thereby conducting a return movement.

Figure 6D:
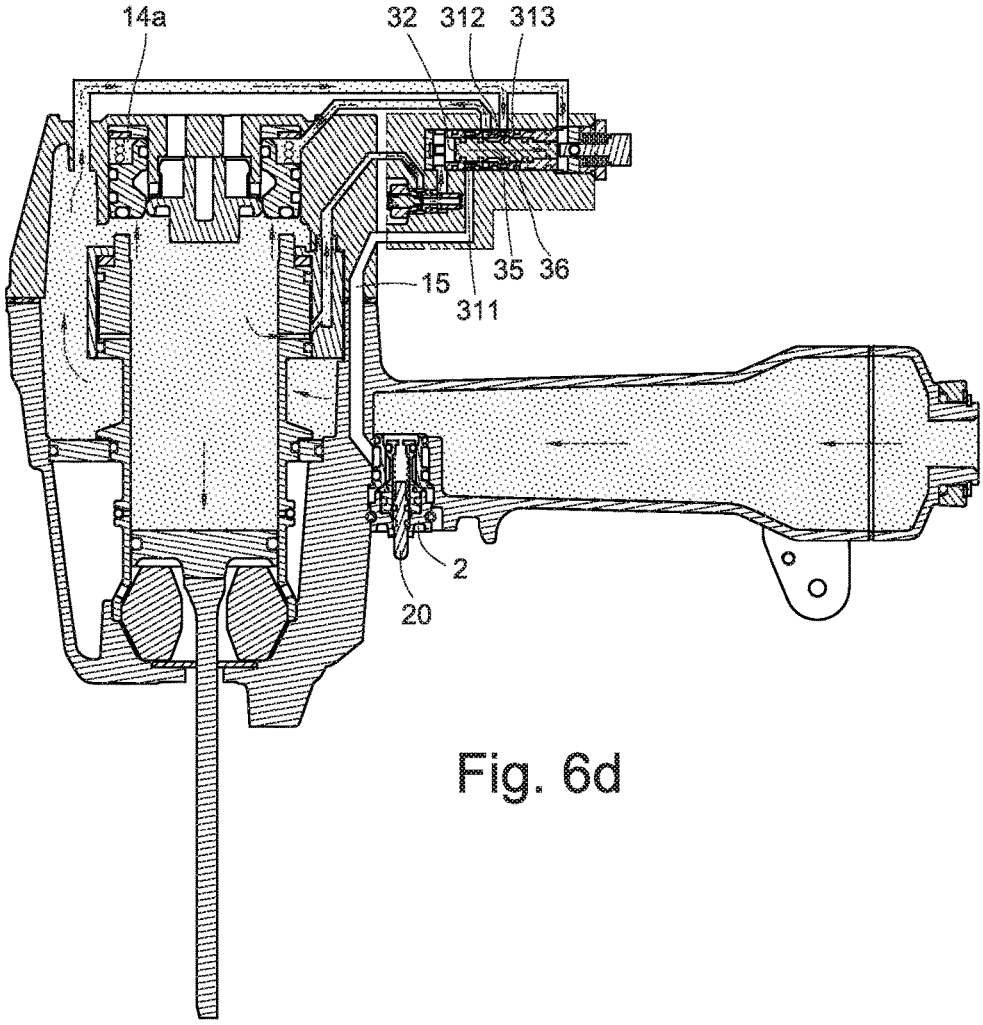

FIG. 6*d* shows that the return movement of the valve stem 32 causes the first control portion 35 to stop the communication between the first guide hole 311 and the second guide hole 312, so that the communication between the top chamber 14*a* and atmosphere by way of the trigger passage 15 is stopped. On the other hand, the second control portion 36 of the valve stem 32 can start a communication between the second guide hole 312 and the third guide hole 313, so that the pressurized air in the main chamber 10*a* can be introduced into the top chamber 14*a*.

Figure 6E:
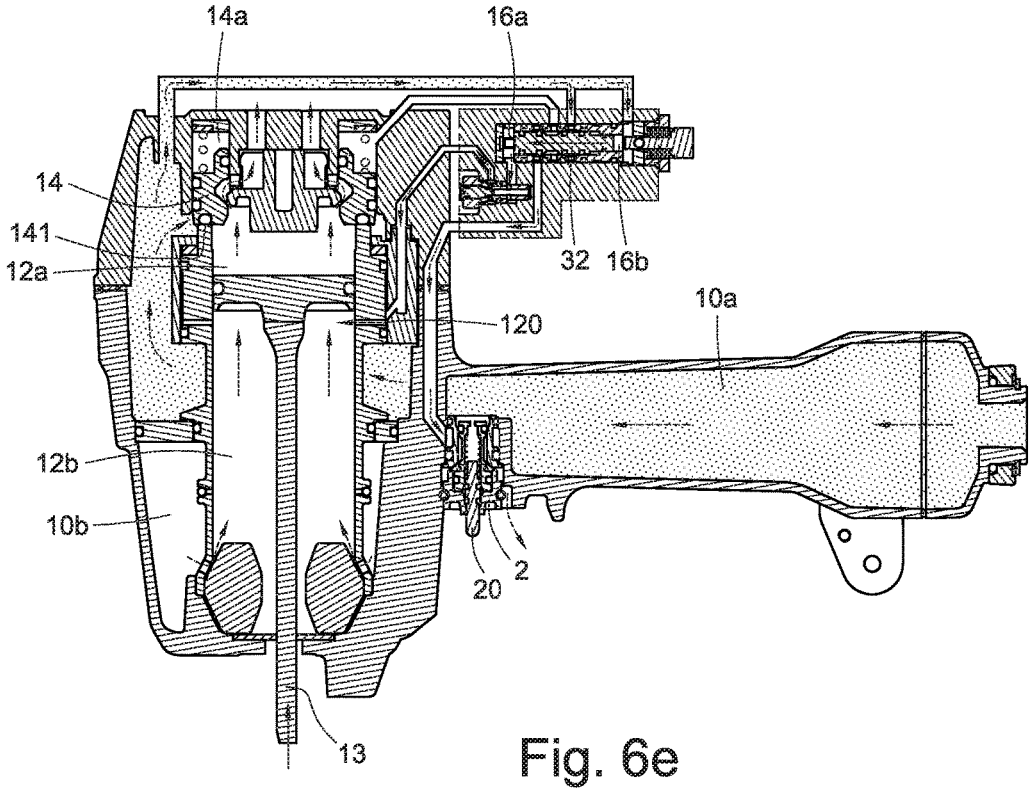

FIG. 6*e* shows that the pressurized air entering the top chamber 14*a* will force the poppet valve 14 to move downwardly so that the gap 141 between the poppet valve 14 and the cylinder 12 will be closed again, and a communication between the upper cylinder chamber 12*a* and atmosphere will be opened (known as a prior art), so that the pneumatic pressure of the upper cylinder chamber 12 a can be reduced. Under these circumstances, the piston together with the drive blade 13, which has completed the drive stroke, can be forced by the pressurized air accumulated in the return chamber 10*b* to move up (known as a prior art), thereby conducting a return movement, so that the drive blade 13 can return to the top position (P1). During the upward movement, when the piston passes by the return port 120, the first chamber 16*a* can communicate with the lower cylinder chamber 16*b* via the return port 120 and the return air conduit 18, so that the pneumatic pressure of the first chamber 16*a* can be reduced, so that the pressurized air acting on the second end surface 322 in the second chamber 16*b* can force the valve stem 32 to conduct a forward movement again, so that the nail gun can return to the state of FIG. 6*b* where the user has just depressed the actuating bar 20.

In FIGS. 6*b*, 6*c*, 6*d* and 6*e*, the actuating bar 20 of the trigger valve 2 is maintained at a depressed state. With the arrangement of the shuttle valve 3 and the associated pneumatic system, the valve stem 32 can be repeatedly driven to conduct forward and return movements along the inner bore 34 of the valve seat 31, so that the nail gun can be operated in automatic actuation mode, where the nail gun can conduct repeated drive strokes by depressing the actuating bar 20 a single time. However, in FIG. 6*e*, the user may release the actuating bar 20 after the piston has returned to the initial state, where the drive blade 13 is at the top position (P1). If the actuating bar 20 is released when the nail gun is at the state of FIG. 6*e*, the nail gun can stop a next stroke and return to the state of FIG. 6*a*. If the actuating bar 20 is depressed again when the nail gun is at the state of FIG. 6*a*, another repeated strokes, as shown in FIGS. 6*b*, 6*c*, 6*d* and 6*e*, can be initiated again.

Figure 7:
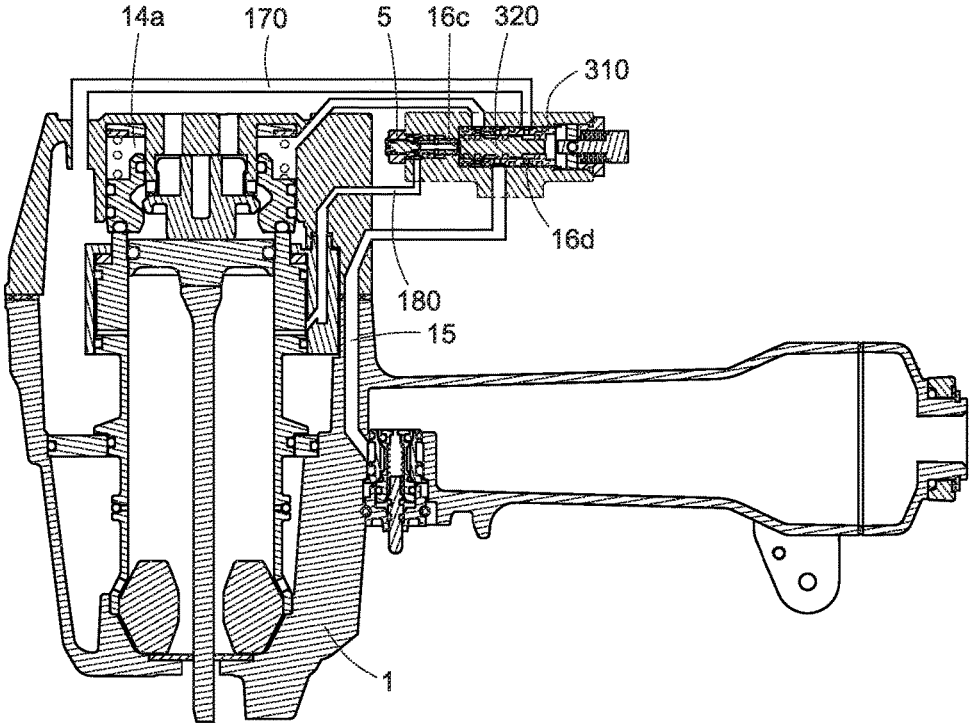
FIG. 7 shows a sectional view of a pneumatic nail gun according to a second embodiment of the present invention.
Figure 8:
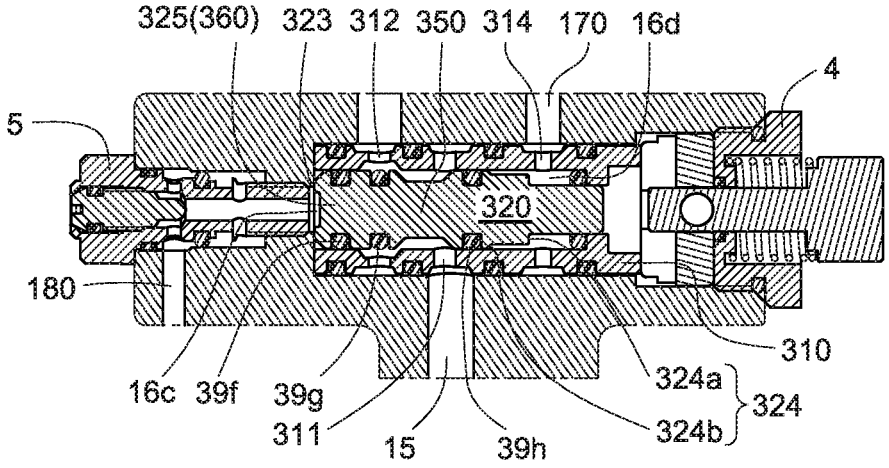
FIG. 8 shows an enlarged sectional view of a shuttle valve, together with a throttle valve and a switching device, employed in the pneumatic nail gun of the second embodiment of the present invention.

FIGS. 7 and 8 show a second embodiment of the present invention, which differs from the first embodiment in the arrangement of the guide holes of the valve seat 310 and the control portions of the valve stem 320.

As shown, at least one gas-tight seal ring 39*f* is provided at the valve stem 320, near the first end surface 323 of the stem. The seal ring 39*f* constitutes a head portion 325, which serves as the second control portion 360 for regulating a communication between the first chamber 16*c* and the second guide hole 312. In this embodiment, the second control portion 360 is used for regulating pressurized air to enter the top chamber 14*a*, as the second control portion 36 of the first embodiment is used. However, in the second embodiment, the pressurized air entering the top chamber 14*a* is by way of the first chamber 16*c* instead of the third guide hole 313 of the valve seat 31 of the first embodiment. In operation, when the first chamber 16*c* is at a condition of lower pneumatic pressure, which is similar to the condition of FIGS. 6*b* and 6*e* for the first embodiment, the valve stem 320 can be forced to conduct a forward movement towards the first chamber 16*c*. On the other hand, when the first chamber 16*c* of the second embodiment is full of pressurized air, the nail gun will undergo the states similar to those shown in FIGS. 6*c* and 6*d*, wherein the valve stem 320 can conduct a return movement. More specifically, pressurized air can enter the first chamber 16*c* by way of the return air conduit 180 to have the valve stem 320 conduct a return movement, so that the head portion 325 (i.e., the second control portion 360) can start a communication between the first chamber 16*c* and the second guide hole 312. When the drive blade 13 has completed a downward drive stroke, due to the pneumatic pressure of the first chamber 16*c* is decreasing upon the gap 141 having been closed, the pressurized air in the second chamber 16*d* can force the valve stem 320 to conduct a forward movement, so that the head portion 325 (i.e., the second control portion 360) can stop the communication between the first chamber 16*c* and the second guide hole 312.

As shown in FIG. 8, the portion between the seal rings 39*g*, 39*h* constitutes the first control portion 350, wherein the seal ring 39*g* can regulate a communication between the first guide hole 311 and the second guide hole 312, which in turn control the communication between the top chamber

14*a* and the trigger valve 2 by way of the trigger passage 15. The function of the first control portion 350 is same as the counterpart described in the first embodiment, and thus a detailed description therefor is omitted here.

As shown in FIG. 8, there is provided a third guide hole 314 at the wall of the valve seat 310, between the forward air conduit 170 and the second chamber 16*d* for communicating the forward air conduit 170 with the second chamber 16*d*. The second end surface 324 of the valve stem 320 includes two coaxially annular surfaces 324*a*, 324*b* being exposed to the second chamber 16*d*. The structure of the second end surface 324 can produce same effect as the counterpart of the first embodiment. In addition, the switching device 4 of the second embodiment has the same structure as the counterpart of the first embodiment, and thus a detailed description therefor is omitted here.

As shown in FIGS. 7 and 8, the second embodiment can simplify the arrangement of the shuttle valve 3, wherein the throttle valve 5 is located at a location directly next to the first chamber 16*c*, and this can reduce the length of the return air conduit 180. When compared with the first embodiment, except that the second embodiment has same functions and advantages as the first embodiment, the second embodiment can simplify the arrangement of pneumatic passages and thus can save the manufacturing cost of a nail gun.

It is noticed that the throttle valve 5 being arranged directly next to the first second chamber 16*c* and cooperated with the shuttle valve 3 enables the second embodiment to achieve same results as the first embodiment, the features and working states of which are shown in FIGS. 1, 6*a*, 6*b*, 6*c*, 6*d* and 6*e*.

The above embodiments illustrate preferred ways for implementing the present invention. However, they are not intended to limit the scope of the present invention. Accordingly, the scope of the present invention should be interpreted from the claims hereinafter appended.

We claim:

1. A pneumatic nail gun, which comprises:

a gun body provided therein with a cylinder and a poppet valve on top of the cylinder, the gun body defining therein a main chamber that is supplied with pressurized air and defining therein a top chamber overdisposed above the poppet valve, wherein a piston together with a drive blade is slidably fitted in the cylinder;

a trigger valve, mounted to the gun body and communicated with the top chamber via a trigger passage composed of a first segment and a second segment, for regulating the pressurized air in the main chamber to enter the top chamber via the trigger passage and regulating the pressurized air in the top chamber to be released to atmosphere via the trigger passage;

a shuttle valve mounted to the gun body, the shuttle valve including a substantially cylindrical, movable valve stem; and a forward air conduit and a return air conduit provided in the gun body for guiding the pressurized air in the main chamber to flow into the shuttle valve to cause forward and return movement of the valve stem of the shuttle valve for regulating the pressurized air in the main chamber to enter the top chamber via the trigger passage, so that the drive blade can be forced to conduct repeated drive strokes for striking a nail in automatic actuation mode;

wherein the return air conduit is communicated with at least one return port defined at the cylinder between a top dead center and a bottom dead center of the piston; when the pneumatic nail gun conducts a drive stroke, the piston will pass by the return port and the drive blade will move from a top position to a bottom position;

wherein the shuttle valve further includes a tubular valve seat fixed in the gun body, and the valve stem is mounted in the tubular valve seat and movable along a longitudinal, central axis of the tubular valve seat;

wherein the valve stem of the shuttle valve has a first end surface and a second end surface respectively at two opposite ends thereof; the gun body defines a first chamber and a second chamber, wherein the first end surface of the valve stem is exposed to the first chamber while the second end surface of the valve stem is exposed to the second chamber; the first end surface has a pneumatically acted area greater than the second end surface;

wherein the forward air conduit is connected between the main chamber and the second chamber, and the return air conduit is connected between the return port and the first chamber;

wherein a first control portion and a second control portion are provided at the valve stem within the valve seat, a first guide hole is defined at the valve seat to communicate with the trigger valve via the first segment of the trigger passage, and a second guide hole is defined at the valve seat to communicate with the top chamber via the second segment of the trigger passage, wherein the first control portion regulates a communication between the first guide hole and the second guide hole;

wherein a third guide hole is defined at the valve seat to communicate with the main chamber via an additional air conduit, and the second control portion regulating a communication between the third guide hole and the second guide hole.

2. The pneumatic nail gun of claim 1, wherein the gun body includes a cover which accommodates the valve seat and the valve stem of the shuttle valve.

3. The pneumatic nail gun of claim 1, wherein the additional air conduit is connected to the forward air conduit.

4. The pneumatic nail gun of claim 1, wherein the second control portion is located between the first control portion and the second end surface of the valve stem.

5. The pneumatic nail gun of claim 1, which further comprises a throttle valve defining therein a throttle passage that is in serial connection with the return air conduit.

6. The pneumatic nail gun of claim 5, wherein the throttle valve includes a threaded bolt being fitted into the throttle passage for adjusting the flow of pressurized air passing through the throttle passage.

7. The pneumatic nail gun of claim 6, wherein the gun body includes a cover which accommodates the shuttle valve and the throttle valve, and the threaded bolt has a head being exposed to an outer surface of the cover to facilitate a user to adjust the throttle valve.

8. The pneumatic nail gun of claim 1, which further comprises a switching device including a spring-biased control element being provided with an engagement pin near a free end thereof, the control element movable between a first position and a second position, the engagement pin being able to fix the control element in the first position, wherein when the control element is at the first position, the control element is in contact with the second end surface of the valve stem so that forward and return movements of the valve stem will be blocked; when the control element is at the second position, the control element is clear of the second end surface of the valve stem so that forward and return movements of the valve stem will be permitted.

9. The pneumatic nail gun of claim 8, wherein the gun body includes a cover which accommodates the valve seat and valve stem of the shuttle valve and the switching device, the control element of the switching device has an operable end being exposed to an outer surface of the cover.

10. The pneumatic nail gun of claim 1, wherein the valve stem of the shuttle valve has a head portion embodying the first end surface and serving as the second control portion for regulating a communication between the second guide hole and the first chamber.

11. The pneumatic nail gun of claim 10, wherein when the pressurized air in an upper cylinder chamber of the cylinder is transferred via the return air conduit to the first chamber, the valve stem will conduct a return movement to start a communication between the first chamber and the second guide hole; when a lower cylinder chamber of the cylinder is communicated with the first chamber via the return air conduit, the pressurized air in the second chamber will force the valve stem to conduct a forward movement to stop the communication between the first chamber and the second guide hole.

12. The pneumatic nail gun of claim 10, which further comprises a throttle valve provided at a location next to the first chamber, the throttle valve defining therein a throttle passage that is serially connected between the return air conduit and the first chamber.

13. The pneumatic nail gun of claim 12, wherein the throttle valve includes a threaded bolt being fitted into the throttle passage for adjusting the flow of pressurized air passing through the throttle passage.

14. The pneumatic nail gun of claim 13, wherein the gun body includes a cover which accommodates the valve seat and valve stem of the shuttle valve and the throttle valve, and the threaded bolt has a head being exposed to an outer surface of the cover to facilitate a user to adjust the throttle valve.

15. The pneumatic nail gun of claim 10, which further comprises a switching device including a spring-biased control element capable of moving between a first position and a second position; when the control element is at the first position, the control element is in contact with the second end surface of the valve stem, so that forward and return movements of the valve stem will be blocked; when the control element is at the second position, the control element is clear of the second end surface of the valve stem so that forward and return movement of the valve stem will be permitted.

16. The pneumatic nail gun of claim 15, wherein the gun body includes a cover which accommodates the valve seat and valve stem of the shuttle valve and the switching device, and the control element of the switching device has an operable end being exposed to an outer surface of the cover.

17. A pneumatic nail gun, which comprises:

a gun body provided therein with a cylinder and a poppet valve on top of the cylinder, the gun body defining therein a main chamber that is supplied with pressurized air and defining therein a top chamber disposed above the poppet valve, wherein a piston together with a drive blade is slidably fitted in the cylinder;

a trigger valve, mounted to the gun body and communicated with the top chamber via a trigger passage composed of a first segment and a second segment, for regulating the pressurized air in the main chamber to enter the top chamber via the trigger passage and regulating the pressurized air in the top chamber to be released to atmosphere via the trigger passage;

a shuttle valve mounted to the gun body, the shuttle valve including a substantially cylindrical, movable valve stem; and a forward air conduit and a return air conduit provided in the gun body for guiding the pressurized air in the main chamber to flow into the shuttle valve to cause forward and return movement of the valve stem of the shuttle valve for regulating the pressurized air in the main chamber to enter the top chamber via the trigger passage, so that the drive blade can be forced to conduct repeated drive strokes for striking a nail in automatic actuation mode;

wherein the return air conduit is communicated with at least one return port defined at the cylinder between a top dead center and a bottom dead center of the piston; when the pneumatic nail gun conducts a drive stroke, the piston will pass by the return port and the drive blade will move from a top position to a bottom position;

wherein the shuttle valve further includes a tubular valve seat fixed in the gun body, and the valve stem is mounted in the tubular valve seat and movable along a longitudinal, central axis of the tubular valve seat;

wherein the valve stem of the shuttle valve has a first end surface and a second end surface respectively at two opposite ends thereof; the gun body defines a first chamber and a second chamber, wherein the first end surface of the valve stem is exposed to the first chamber while the second end surface of the valve stem is exposed to the second chamber; the first end surface has a pneumatically acted area greater than the second end surface;

wherein the forward air conduit is connected between the main chamber and the second chamber, and the return air conduit is connected between the return port and the first chamber;

wherein a first control portion and a second control portion are provided at the valve stem within the valve seat, a first guide hole is defined at the valve seat to communicate with the trigger valve via the first segment of the trigger passage, and a second guide hole is defined at the valve seat to communicate with the top chamber via the second segment of the trigger passage, wherein the first control portion regulates a communication between the first guide hole and the second guide hole;

wherein the valve stem of the shuttle valve has a head portion embodying the first end surface and serving as the second control portion for regulating a communication between the second guide hole and the first chamber;

wherein a third guide hole is defined at the valve seat for communicating the forward air conduit with the second chamber, and the second end surface of the valve stem includes two coaxially annular surfaces being exposed to the second chamber.

* * * * *